US005732886A

United States Patent [19]

Liaw

[11] Patent Number: 5,732,886

[45] Date of Patent: Mar. 31, 1998

[54] GUIDE DEVICE OF A SPRAY GUN

[76] Inventor: Junn Liang Liaw, 11F-2, No. 43, Jeng Yih Street, Taichung, Taiwan

[21] Appl. No.: 713,919

[22] Filed: Sep. 13, 1996

[51] Int. Cl.[6] ..... B05B 1/30; B05B 7/02; B05B 9/01

[52] U.S. Cl. ..... 239/526; 239/583

[58] Field of Search ..... 239/290, 398, 239/418, 525, 526, 583, DIG. 14

[56] References Cited

U.S. PATENT DOCUMENTS

| | | | |
|---|---|---|---|
| 1,788,810 | 1/1931 | Tittemore | 239/DIG. 14 X |
| 2,093,240 | 9/1937 | Holmquist | 239/418 X |
| 2,804,343 | 8/1957 | Friedell | 239/398 X |
| 5,102,051 | 4/1992 | Smith et al. | 239/526 X |
| 5,279,461 | 1/1994 | Darroch | 239/526 X |

*Primary Examiner*—Andres Kashnikow
*Assistant Examiner*—Robin O. Evans
*Attorney, Agent, or Firm*—Charles E. Baxley, Esq.

[57] ABSTRACT

A guide device of a spray gun includes a needle having a first end thereof inserted through a central hole of a nozzle and a second end of the needle retained in a first tube which has an inner threaded hole defined therein, a rod having a first end thereof threadedly engaged with the inner threaded hole so as to contact the head of the needle and a second end thereof movably connected to a trigger, a guide tube fixedly connected to the nozzle and having a passage defined longitudinally therein which communicates with the central hole of the nozzle, a plurality of grooves defined longitudinally in an outer periphery of the guide tube and each of which communicates with the central hole of the nozzle such that the needle is guided along an axis of the passage of the guide tube.

2 Claims, 5 Drawing Sheets

GUIDE DEVICE OF A SPRAY GUN

BACKGROUND OF THE INVENTION

1. Field of the Invention

The present invention relates to a guide device and more particularly, to a guide device in a spray gun such that a needle is moved stable within a nozzle.

2. Brief Description of the Prior Art

A spray gun is used to spray painting material on an object. A good spray gun is required to spray the paint uniformly. Generally, the spray gun has a needle movably disposed therein which has one end thereof connected to a trigger and the other end thereof inserted through a nozzle such that when the trigger is not pushed, an open end of the nozzle is closed by the needle and when the trigger is pushed, the needle is moved from the open end so as to define an annular space between the needle and an inner periphery of the nozzle. Paint material is therefore ejected by a pressured air flow through the annular space. However, most of the conventional spray guns have a problem which is that the needle will not moved along an axis of the nozzle after being used for a period of time.

The present invention intends to provide a guide device which guide the needle to move along an axis of the guide device so as to mitigate and/or obviate the above-mentioned problems.

SUMMARY OF THE INVENTION

The present invention provides a guide device of a spray gun which has a hand stock and a barrel connected to the hand stock, the barrel having a nozzle disposed to a front end thereof and the nozzle having a central hole defined therein. A trigger is pivotally connected to the barrel and is connected to a sleeve. The guide device comprises a needle having a first end and a second end which has a head, the first end inserted through the nozzle.

A first tube has a first end with a bottom and a second end being an open end. The bottom has a first hole defined therein through which the first end of the needle extends such that the head is retained in the first tube. The first tube has an inner threaded hole defined longitudinally therein.

A rod extends through the sleeve and fixedly connected with the sleeve, the rod having a first end threadedly engaged with the inner threaded hole of the first tube and a second end.

A guide tube is fixedly connected to the nozzle and has a passage defined therein for the first end of the needle extending therethrough. The guide tube has a plurality of grooves longitudinally defined in an outer periphery thereof and the grooves communicating with the central hole of the nozzle such that the needle is guided along the passage.

It is an object of the present invention to provide a guide device of a spray gun and which guides a needle to be moved within a guide tube.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
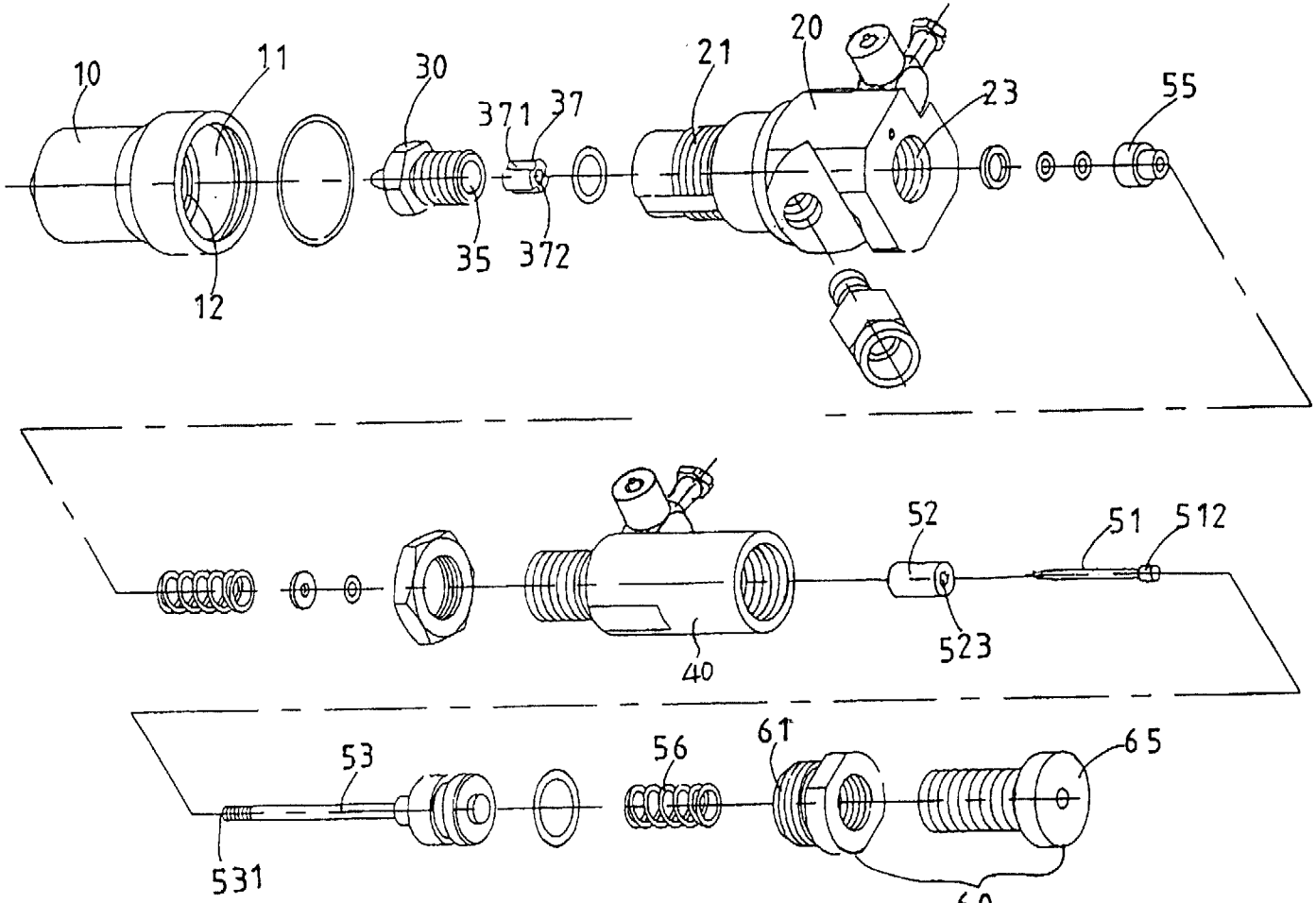
FIG. 1 is an exploded view of a guide device in accordance with the present invention.
Figure 2:
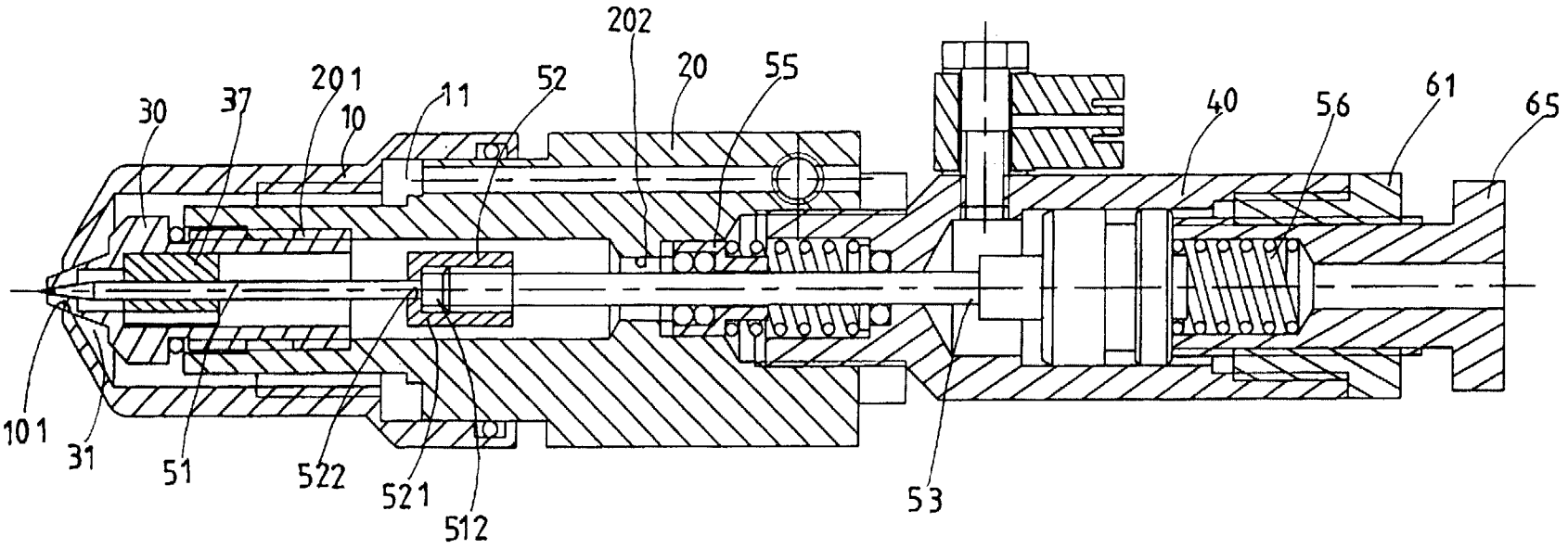
FIG. 2 is a side elevational view, partly in section, of the spray gun equipped with the guide device in accordance with the present invention.
Figure 3:
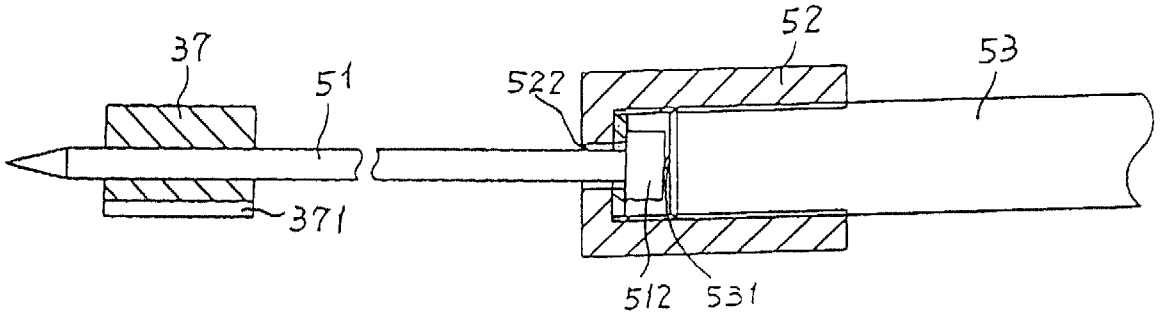
FIG. 3 is an illustrative view to show the rod having a boss contacting the head of the needle in a first tube.
Figure 4:
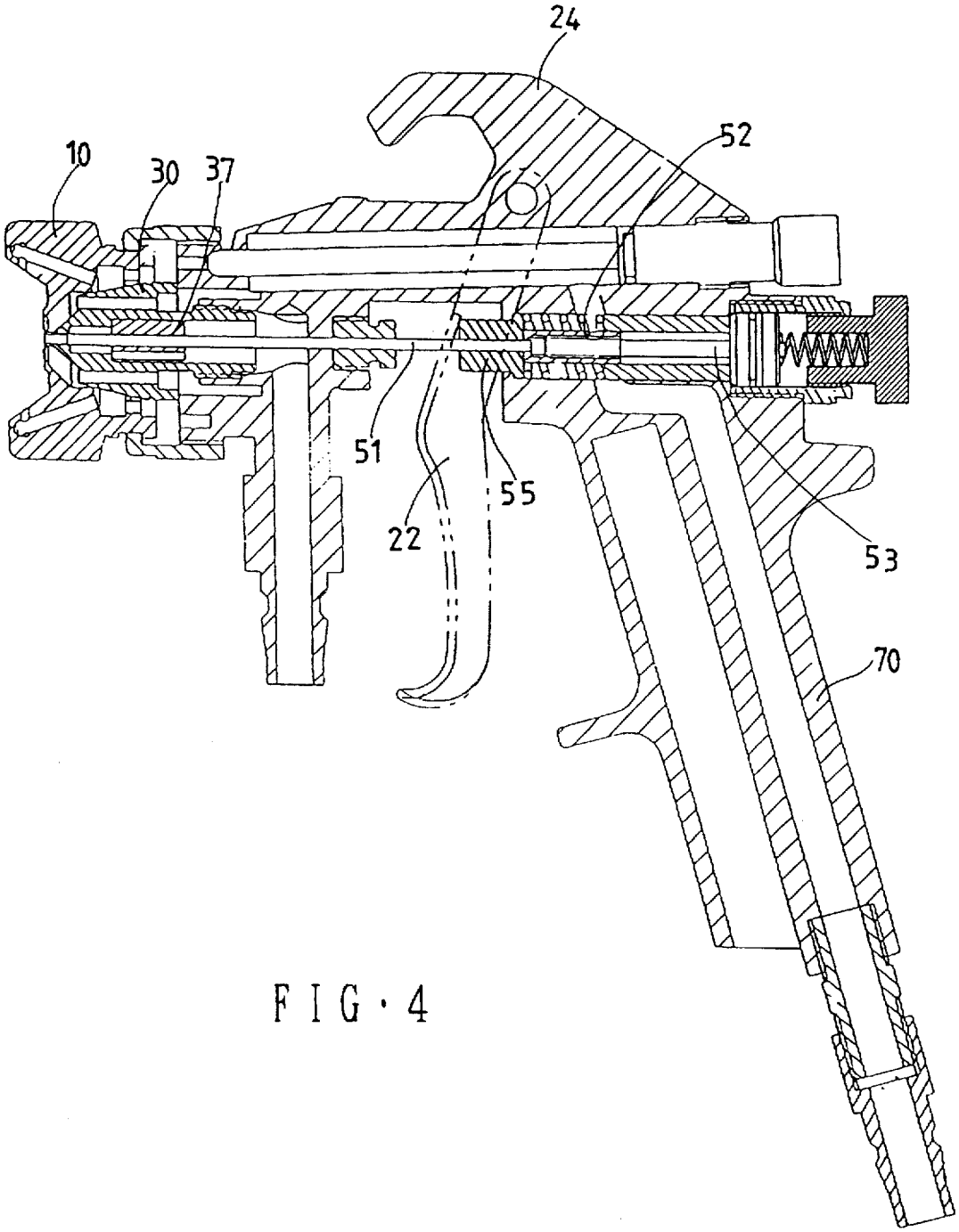
FIG. 4 is a sectional view to show the spray gun when not triggered.

Referring to the drawings and initially to FIGS. 1 through 4, a spray gun has a hand stock 70 and a barrel connected to the hand stock 70. The barrel has a head 10, a middle portion 20, a rear portion 40 and an adjusting portion 60. The head 10 has a front end with a small hole 101 defined therein and a rear end 11 which is an open end having a threaded inner periphery 12 defined therein. The middle portion 20 has a front end thereof having an inner threaded periphery 201 defined therein for a nozzle 30 threadedly engaged therewith and an outer threaded periphery 21 defined in an outer periphery thereof which is engaged with the inner threaded periphery 12 of the head 10. A rear end of the middle portion 20 has a threaded hole 23 defined therein for threadedly engagement with a rear portion 40. The middle portion 20 has a central passage 202 defined therein. The adjusting portion 60 includes a nut 61 which is threadedly engaged with the rear portion 40 and has a threaded inner periphery for receiving a spring 56 therein and threadedly receiving a bolt 65 therein to contact the spring 56.

The nozzle 30 has a front hole 31 defined in a front end thereof and has a central hole 35 defined longitudinally therein.

A needle 51 has a first end and a second end which has a head 512, the first end thereof inserted through the central hole 35 of the nozzle 30 so as to seal the front hole 31.

A first tube 52 has a first end with a bottom 521 and a second end being an open end, the bottom having a first hole 522 defined therein through which the first end of the needle 51 extends such that the head 512 is retained in the first tube 52. The first hole 522 has a diameter larger than that of the needle 51. The first tube 52 has an inner threaded hole 523 defined longitudinally therein.

A rod 53 extends through a sleeve 55 received in the middle portion 20 and is fixedly connected with the sleeve 55. The red 53 has a first end and a second end, the first end thereof threadedly engaged with the inner threaded hole 523 of the first tube 52 and has a boss 531 extending longitudinally therefrom which contacts the head 512 of the needle 51.

A guide tube 37 is fixedly received in the central hole 35 of the nozzle 30 and has a passage 372 defined longitudinally therein for the first end of the needle 51 extending therethrough. The guide tube 37 has a plurality of grooves 371 longitudinally defined in an outer periphery thereof and the grooves 371 communicate with the central hole 35 and the front hole 31 of the nozzle 30.

Figure 5:
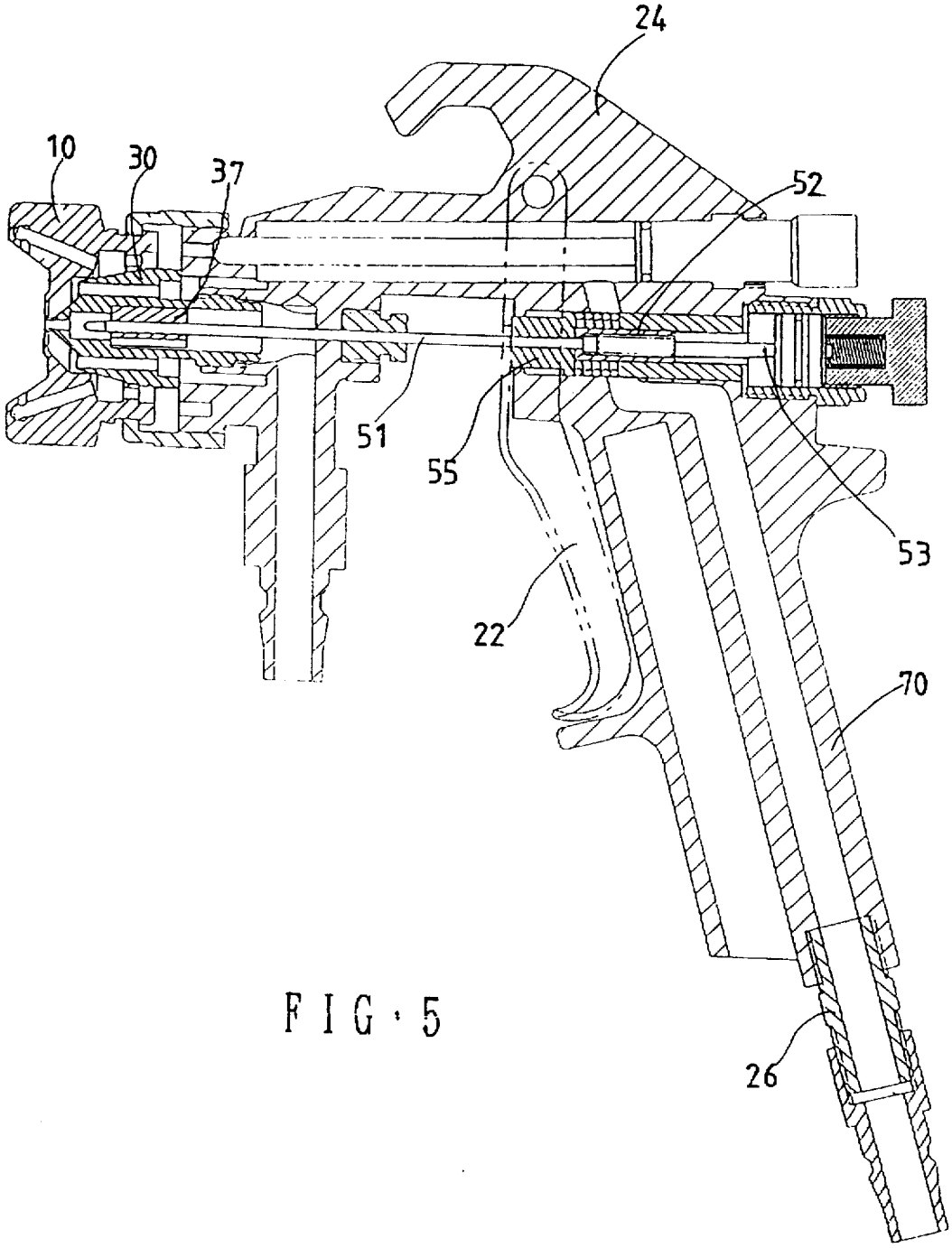
FIG. 5 is a sectional view to show the spray gun when triggered.

A trigger 22 is pivotally connected to a protrusion 24 of the barrel and is connected to the sleeve 55 such that when pulling the trigger 22 as shown in FIG. 5, the rod 53 is moved by a movement of the sleeve 55 and the first tube 52 together with the needle 51 are moved. The needle 51 is guided to move along the passage 372 of the guide tube 37 so as to define an annular space between the first end of the needle 51 and an inner periphery of the front hole 31.

Accordingly, the needle 51 is controlled to move along the guide tube 37 and this ensures the needle 51 is moved centrally from the front hole 31.

In addition, if a longitudinal axis of the guide tube 37 is slightly higher or lower than a longitudinal axis of the first hole 522 of the first tube 52, a user can move the needle 51 slightly within the first hole 522 and the friction between the boss 531 and the head 512 of the needle 51 is small.

Although the invention has been explained in relation to its preferred embodiment, it is to be understood that many other possible modifications and variations can be made without departing from the spirit and scope of the invention as hereinafter claimed.

What is claimed is:

1. A guide device of a spray gun which has a hand stock and a barrel connected to said hand stock, said barrel having a nozzle disposed to a front end thereof, said nozzle having a central hole defined therein, a trigger pivotally connected to said barrel and connected to a sleeve, said guide device comprising:

a needle having a first end and a second end which has a head, said first end inserted through said nozzle;

a first tube having a first end with a bottom and a second end being an open end, said bottom having a first hole defined therein through which said first end of said needle extends such that said head is retained in said first tube, said first tube having an inner threaded hole defined longitudinally therein;

a rod extending through said sleeve and fixedly connected with said sleeve, said rod having a first end and a second end, said first end thereof threadedly engaged with said inner threaded hole of said first tube, and a guide tube fixedly connected to said nozzle and having a passage defined longitudinally therein for said first end of said needle extending therethrough, said guide tube having a plurality of grooves longitudinally defined in an outer periphery thereof and said grooves communicating with said central hole of said nozzle.

2. The guide device as claimed in claim 1 wherein said rod has a boss extending longitudinally from a front end thereof and said boss contacts said head of said needle.

* * * * *